United States Patent [19]

Smith et al.

[11] Patent Number: 4,700,778

[45] Date of Patent: Oct. 20, 1987

[54] WET CONNECTOR FOR USE WITH DRILL PIPE CONVEYED LOGGING APPARATUS

[75] Inventors: Michael L. Smith, Sand Springs, Okla.; Donald E. Hensley, Houston, Tex.

[73] Assignee: Halliburton Company, Duncan, Okla.

[21] Appl. No.: 889,029

[22] Filed: Jul. 24, 1986

[51] Int. Cl.[4] ..... E21B 23/08; E21B 43/112; E21B 47/00

[52] U.S. Cl. ..... 166/250; 166/378; 166/65.1

[58] Field of Search ..... 166/65.1, 66, 240, 250, 166/378, 380, 381, 383

[56] References Cited

U.S. PATENT DOCUMENTS

| | | | |
|---|---|---|---|
| 3,957,119 | 5/1976 | Yonker | 166/383 |
| 4,082,144 | 4/1978 | Marquis | 166/250 |
| 4,349,072 | 9/1982 | Escaron et al. | 166/383 |
| 4,484,628 | 11/1984 | Lanmon, II | 166/378 |
| 4,570,709 | 2/1986 | Wittrisch | 166/378 |
| 4,597,440 | 7/1986 | Pottiel | 166/250 |

*Primary Examiner*—Stephen J. Novosad
*Assistant Examiner*—William P. Neuder
*Attorney, Agent, or Firm*—William J. Beard

[57] ABSTRACT

For use in drill pipe conveyed logging systems wherein the logging apparatus is enclosed in a housing affixed to the lower end of a drill pipe string, a system is disclosed utilizing a wet connector and overshot. The wet connector includes a centralized upstanding mechanical connector means having a J-slot cooperative with pins inserted thereinto. The J-slot is adjacent to a sleeve which telescopes over an enclosed and protected upwardly facing electrical connector means. On the overshot, the solid body thereof includes a lower appended skirt having inwardly protruding pins which engage the J-slots to achieve a separate mechanical connection. There is internally of the overshot a spring mounted telescoping and movable electrical connector including a cooperative socket engaging the plug of the wet connector. The electrical connection is kept separate from the mechanical connection so that the entire load of operation is carried separately without interfering with operation of the electrical connectors.

18 Claims, 11 Drawing Figures

WET CONNECTOR FOR USE WITH DRILL PIPE CONVEYED LOGGING APPARATUS

BACKGROUND OF THE DISCLOSURE

While most wells are drilled more or less vertically, it is not uncommon to deviate a well so that it is drilled at an angle from the vertical. A typical situation arises with an offshore platform where many wells are brought to the surface at the platform. It is not uncommon to find as many as thirty wells at a single platform. While several of the wells might deviate only a few degrees from the vertical, a large number of such wells will deviate outwardly from the platform to place a number of wells into a productive formation. Of the thirty wells, perhaps as many as twenty will be substantially deviated from the vertical. They will typically radiate in all directions of the compass on viewing the platform from above. The angle of deviation in a given well will vary significantly. Deviation angles in the range of zero to about 45 degrees still permit the use of wireline supported equipment in the drilling of the well, and various and sundry completion techniques. When a well is highly deviated, typically in the range of about 45 to about 75 degrees, it is more appropriate to describe the well as being horizontal than vertical, at least in the deviated portion. Such high angles of deviation from the vertical create more or less horizontal portions in the well, and there are difficulties in getting wireline tools through such highly deviated portions.

Wireline supported tools, whether supported on a slick line or on a multi-conductor armored logging cable, including a support wire and various conductors, all operate successfully by traversing the well borehole by gravity. Gravity fall and wireline retrieval is thus a routine matter in getting wireline supported tools into and out of the well borehole. In a highly deviated well, the wireline supported tools do not travel so readily.

In a highly deviated hole, wireline tools may snag or hang on the rough surface that defines the drilled hole. In open hole, the surface can vary over a wide range of roughness. Even when it is smoothed by a mud cake there still is a high risk of snagging the gravity moved wireline tool. Even if the hole has been cased, there is still an element of risk of snagging the tool at threaded connections between joints.

One approach to overcoming the possibility of snagging in highly deviated holes is to run the logging tool into the well on a string of drill pipe. This is described as being "drill pipe conveyed". An assembly is connected to the lower end of a string of drill pipe and is forced into the deviated hole to position the logging apparatus at a specified depth in the hole. When this is done, positioning can be achieved in a reliable fashion, but it is then difficult to get the signals created by the logging apparatus out of the well. For instance, logging apparatus supported by a string of drill pipe may form a multitude of signals transmitted from the logging apparatus up through the drill string. Heretofore, signals have been delivered by means of various conductors in an armored logging cable. While the drill pipe is made of metal and can serve as a pipe conductor, in practice, quality of the conductor is so poor that an electrical connection must be made with a high quality conductor wire, one pair or more, to thereby provide a signal path. Moreover, some logging tools utilize electrical power and thus, a quality connection must be made from the surface to the logging tool (on the drill string) whereby electric current flows from the surface to the logging apparatus. The required quality of connection mandates the use of a logging cable including at least a pair of conductors to deliver electric current from the surface to the logging apparatus, and also, the incorporation of suitable conductor paths to deliver signals from the logging apparatus back to the surface. This can be done with a pair of conductors, if nothing else through the use of multiplexing to obtain the equivalent of more than a single conductor pair.

With this background in mind, the present disclosure is directed to a system whereby a logging tool in the form of an assembly affixed to a string of drill pipe is first installed at a suitable depth in the well. Thereafter, an overshot is dropped into the string of drill pipe. If it tends to stall, it can be pumped down by the use of a drilling fluid such as drilling mud. This will force it to the bottom. At that point, the overshot makes mechanical and electrical connection to the logging assembly for the purpose of providing the quality electrical connection required for operation. The present apparatus enables a connection to be made, disclosing a pump-down overshot cooperative with a wet connector. Moreover, it enables mechanical connection utilizing a type of self-cleaning boot with a bayonet connector featuring a J-slot which enables a positive mechanical connection to be made. it is not sensitive to dynamic pressure which may vary widely depending upon circumstances of the deviated well. Connection is achieved wherein the mechanical load is handled separately, in a manner of speaking, so that separate and proper electrical connection is achieved. The overshot latches to the wet connector assembly at the bottom of the string of drill pipe, thereby assuring proper operation of the system. By proper manipulation of wireline tension, connection can be made and then connection can be ended enabling retrieval of the wireline and the overshot affixed to it.

While the foregoing sets forth the problem and mentions briefly certain features of the present apparatus, the detailed description set forth below will more clearly describe the construction of the apparatus and its mode of operation.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The drill pipe conveyed logging assembly of FIG. 1 will be described first. Then, the wet connector which is affixed to the lower end of the drill pipe will be described in detail. After that, the overshot assembly shown in FIG. 3 will then be described, at which time, a sequence of operation of the equipment will then be set forth.

Figure 1A:
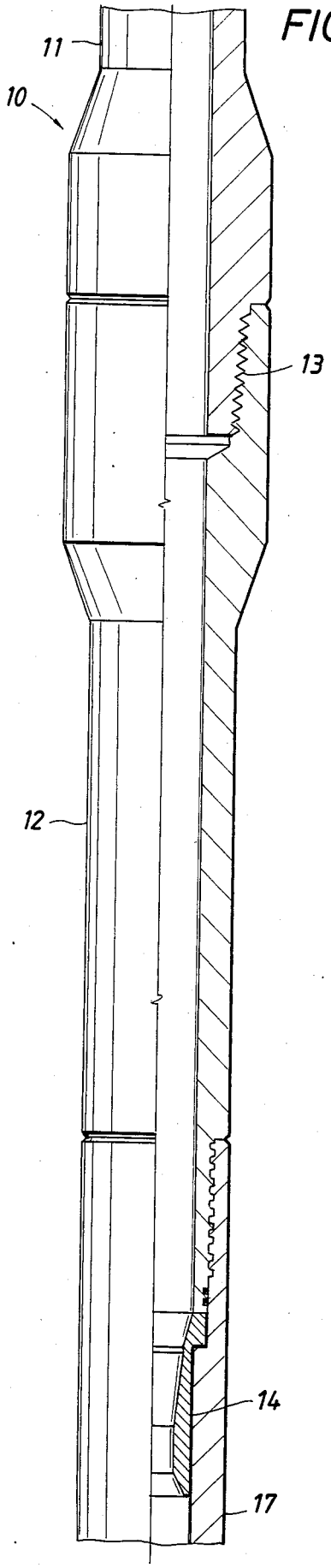
FIGS. 1A–1C show a drill pipe conveyed logging assembly which is adapted to be positioned in a highly deviated hole to locate the logging assembly at a required depth.
Figure 1B:
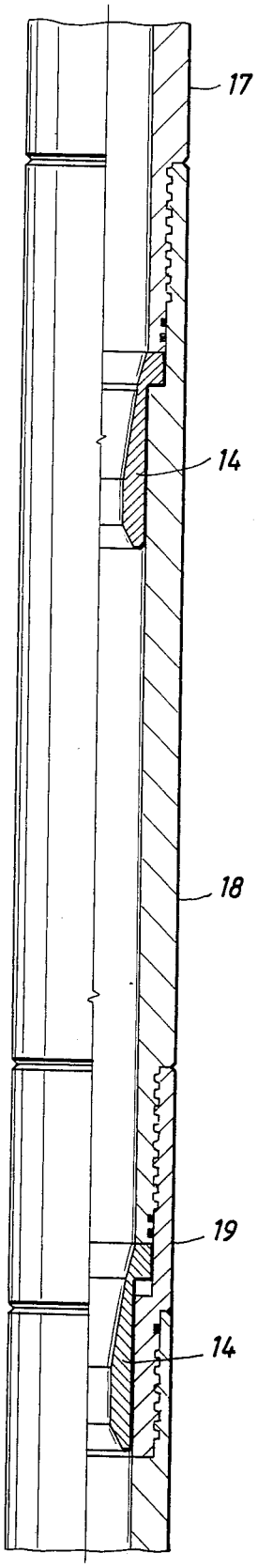
Figure 1C:
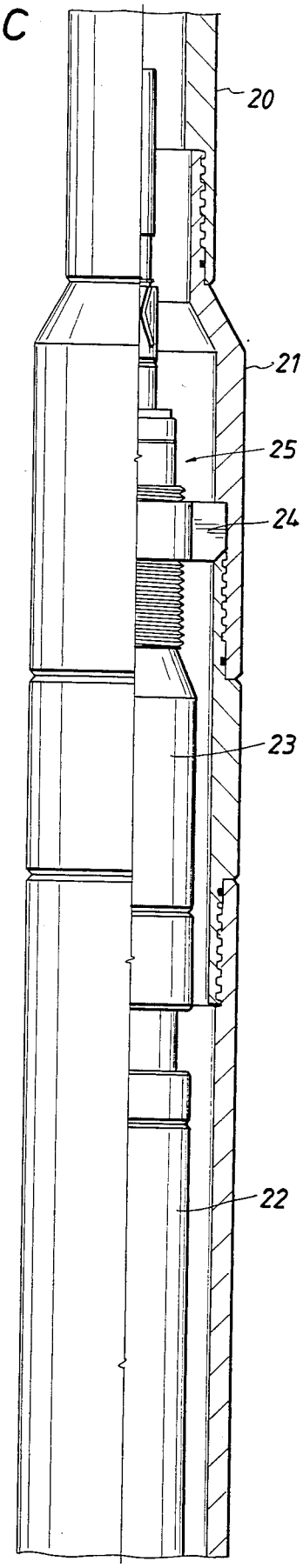

In FIG. 1 of the drawings, the numeral 10 identifies a drill string. A single joint of drill pipe is indicated at 11 and it is threaded to a centralizer housing adapter 12 by means of a conventional, typical threaded connection 13. At the last threaded connection or perhaps bottommost two or three threaded connections, an interval sleeve 14 is incorporated which guides or centralizes the overshot. The centralizers 14 centralize and direct the overshot so that it will make certain contact with the logging assembly as will be described. the drill pipe joints can be of conventional construction andlength, typically 30 feet being normal. The centralizer members 14 are spaced closer together and thus short subs are used at 17 and 18 to space the centralizers 14. They are located to assure proper alignment and connection of the overshot to the wet connection. The sub 18 thus threads to a cooperative sub 19 which in turn threads to a sleeve 20. The sleeve 20 threads to a transition piece 21 which has a larger OD, and the passage onthe interior becomes larger. It is larger to enclose a housing 22 which encloses a suitable logging tool. The precise nature of the logging tool is not given. Various and sundry logging tools can be used with this equipment and are placed in the housing 22. To this end, the transition piece 21 may be constructed of special metals. For instance, metals which do not interfere with magnetic fields may be used. A wide variety of logging tools can be incorporated in the housing 22 and the particular nature of the logging tool is not specified.

The logging tool is located in the housing 22. That housing connects to what is termed a closure head 23 at the top end of the housing 22. In turn, that supports the wet connector of the present disclosure identified generally by the numeral 25. The wet connector is centralized and held in location by a suitable adjusting nut 24. The nut 24 is captured between connected segments of the enlarged housing 21. The exterior of the wet connector is threaded so that the threaded connection can be readily achieved. The threaded nut 24 thus supports the wet connector 25 and also aligns it centrally of the drill pipe. Details of construction of the wet connector 25 will be set forth on describing FIG. 2. It is sufficient to note that it incorporates an upstanding central member which extends upwardly toward the centralizers 14 for mechanical connection. Moreover, it provides an electrical connection from the logging tools in the housing at 22.

In operation, the apparatus shown in FIG. 1 is installed in a deviated hole by assembling the string of drill pipe joint by joint. The drill pipe is measured in length. This enables control over the location of the logging tools, thereby assuring that the logging tools are positioned at a required depth in the deviated hole. For instance, suitable pipe can be added to locate the logging tools at a specified depth of 10,000 feet. Here, the term depth refers to length along the deviated hole, and it does not necessarily refer to depth into the earth. When the drilled well is true to vertical, the two measurements are the same, but in this instance, the highly deviated well requires measurement along the length of the well to the necessary location where the logging tools are used.

Figure 2A:
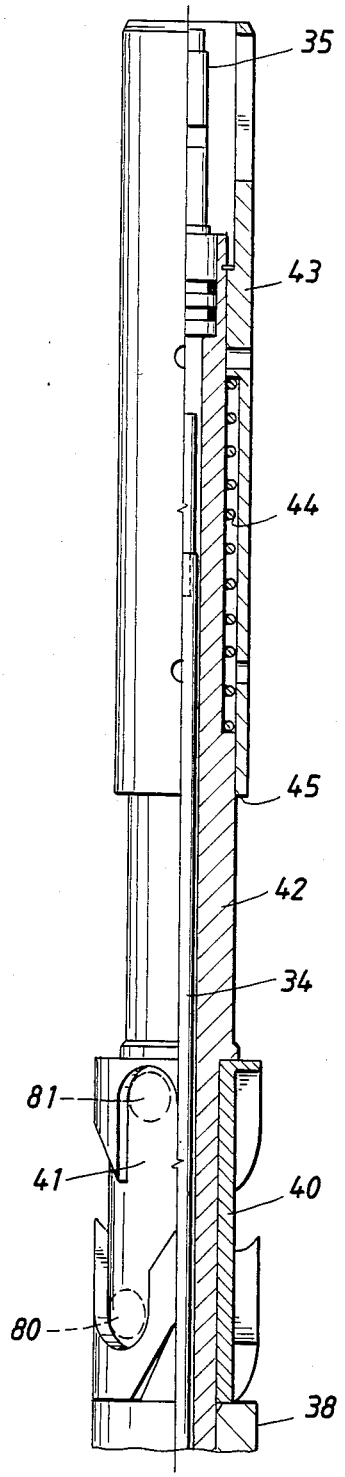
FIGS. 2A and 2B are a detailed sectional view through the wet connector assembly which is connected above the logging assembly and which faces upwardly enabling subsequent electrical connection necessary for operation of the logging tools.
Figure 2B:
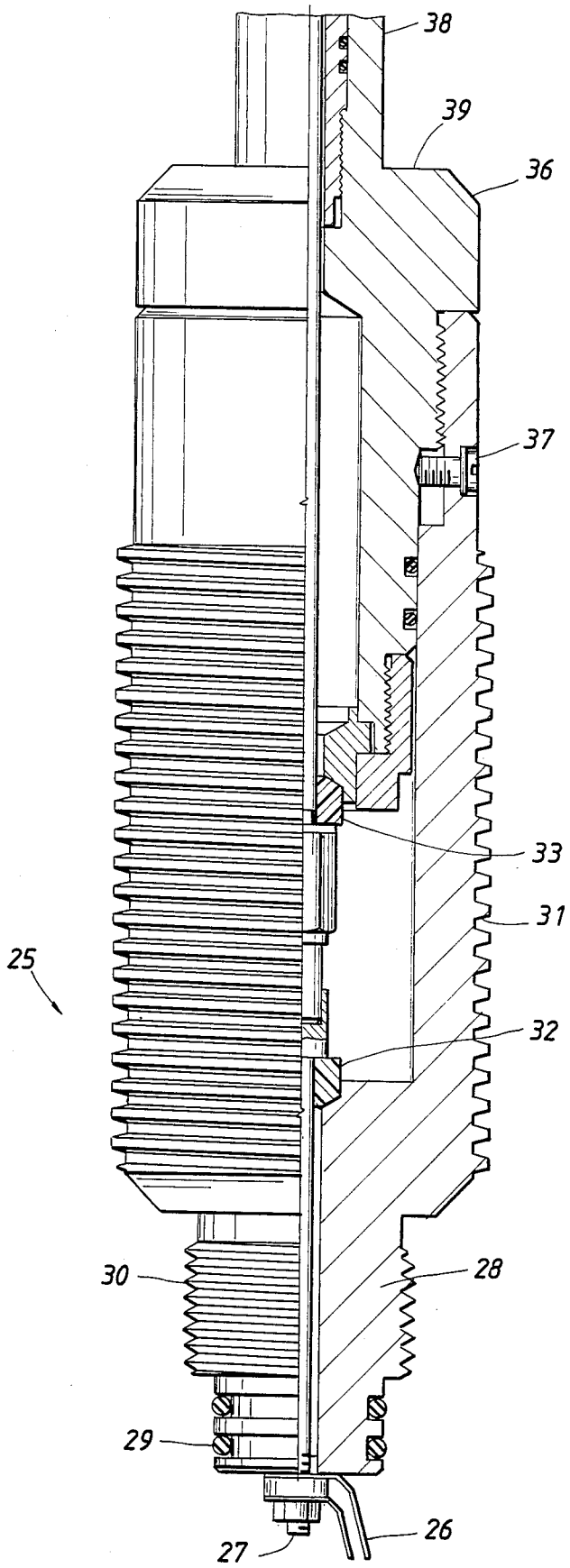
Figure 3A:
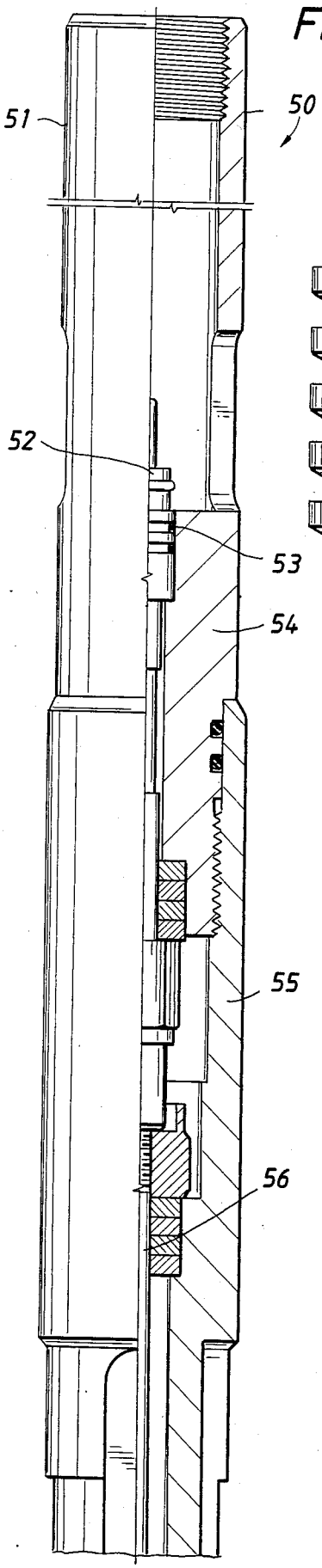
FIGS. 3A–3C are a detailed sectional view along the length of the overshot incorporating a specially designed stinger which connects with the wet connector of FIG. 2.
Figure 3B:
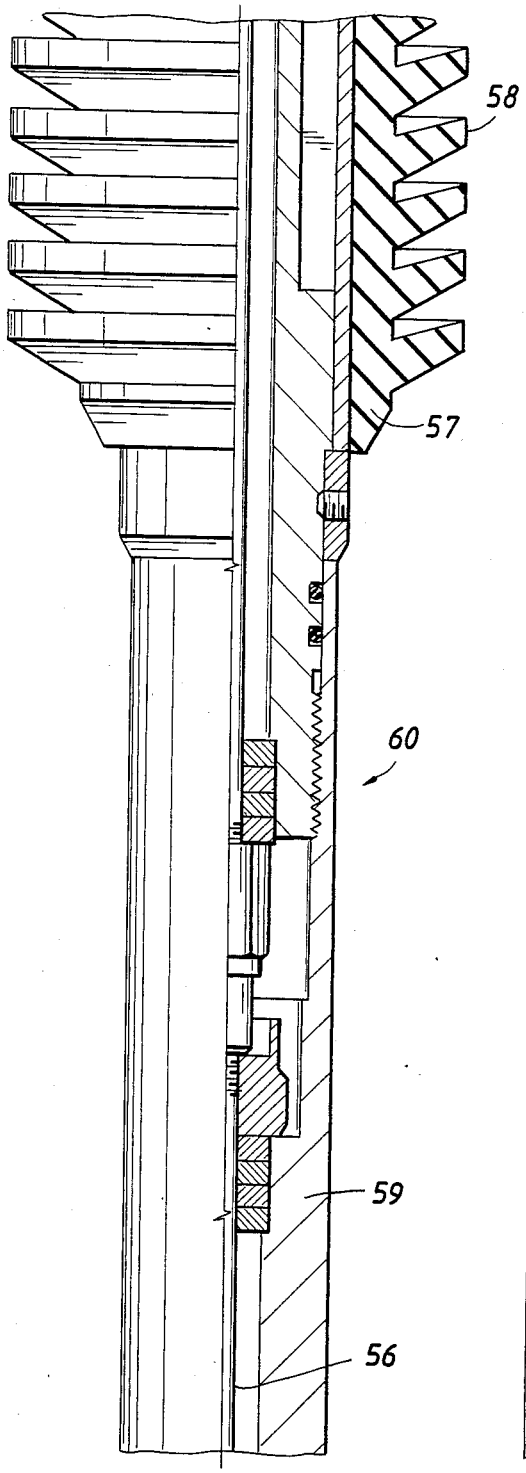
Figure 3C:
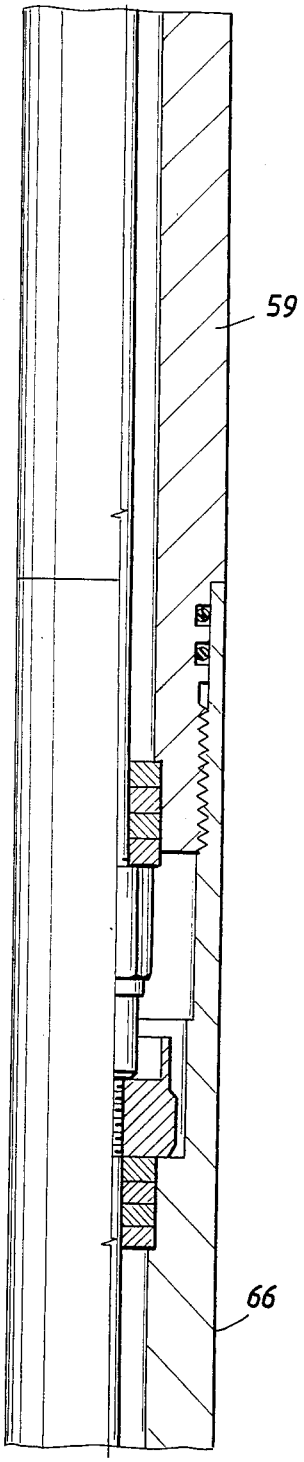
Figure 3D:
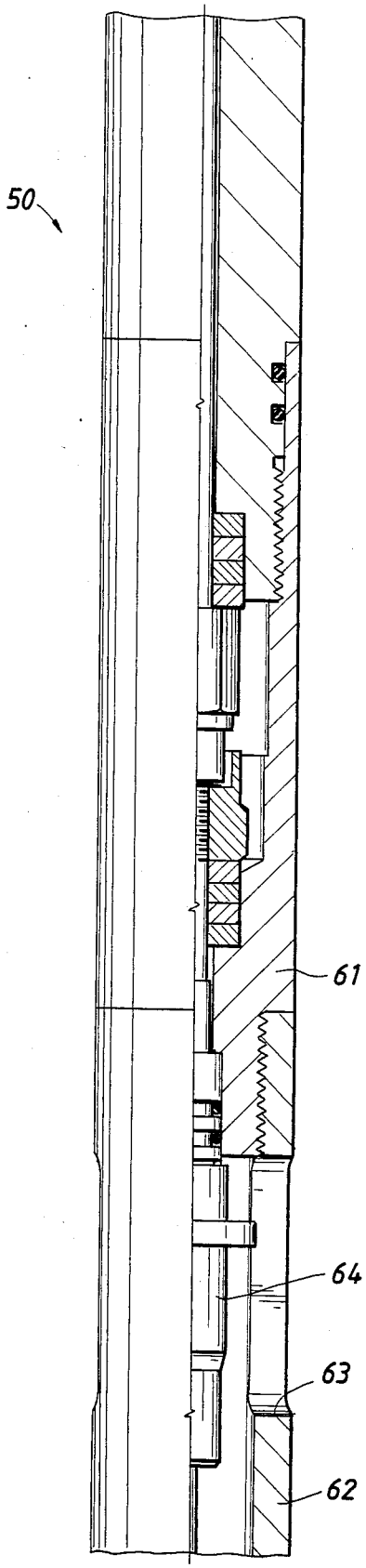
Figure 3E:
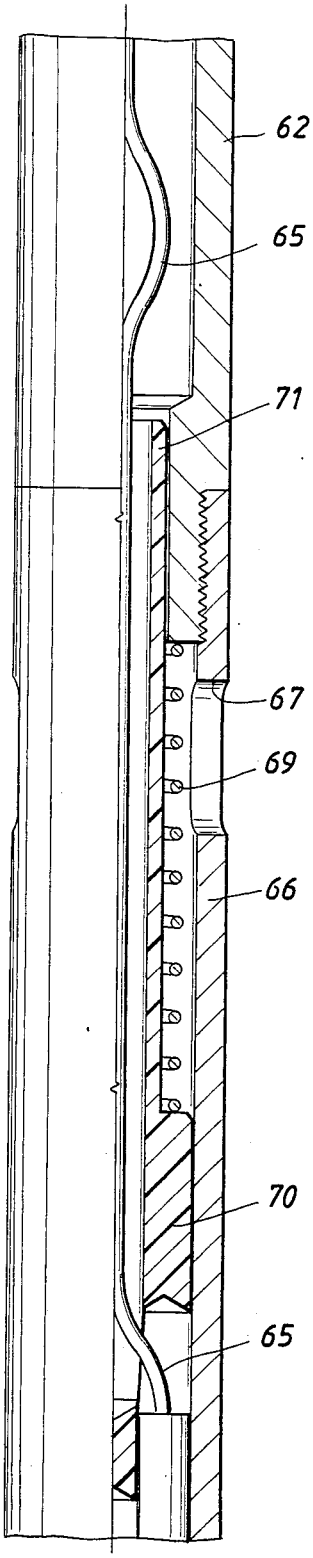
Figure 3F:
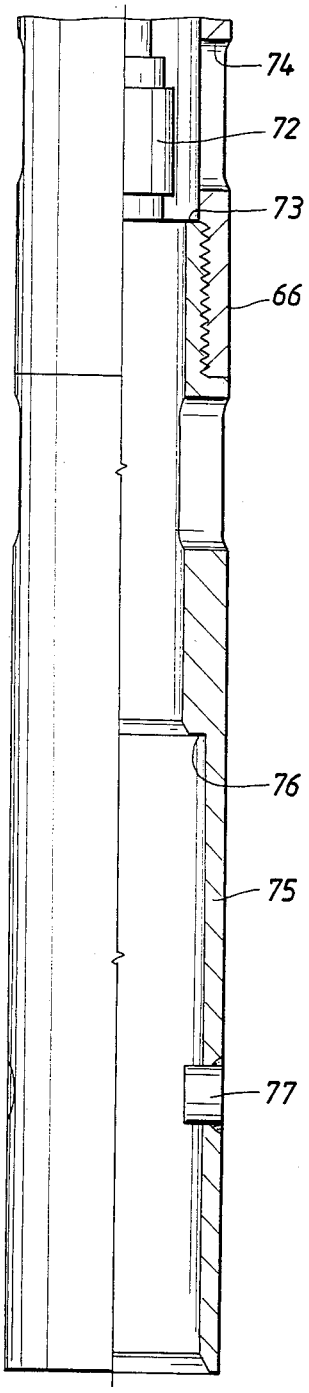

The wet connector shown in FIG. 1 is enlarged in FIG. 2. The description of the wet connector will proceed from the bottom to show how it connects with the logging assembly therebelow. To this end, the numeral 26 identifies signal conductors connected with an insulated conductor post 27 which connects to an insulated pair of conductors through the equipment. The threaded housing 28 has a fluid seal in the seal rings 29. The threads 30 enable the wet connector assembly 25 to thread to the closure head 23 previously described. This locates the threads 31 for connection with the nut 24. The wet connector incorporates an insulated spacer 32 on the interior which aligns the conductor 27. The conductor 27 thus passes through the insulated spacer 32, and is also held in position by similar insulating spacer 33. The conductor is on the interior of an elongate central rod 34. The rod 34 extends upwardly to the very tip of a central plug 35.

The threaded body 28 is closed at the top end by an externally threaded member 36 locked in position by means of a lock screw 37. It includes an upstanding skirt 38 surrounded by an upwardly facing shoulder 39. The skirt 38 supports a J-slot sleeve 40. The sleeve 40 is constructed with a J-slot 41 which enables locking with a cooperative pin. A hollow sleeve 42 defines the upstanding support, the sleeve 42 supporting a surrounding guard sleeve 43. The sleeve 43 telescopes or slides away. The sleeve 43 is also used to centralize the overshot more closely. It slides downwardly against the force of a coil spring 44. Downward travel of the sleeve 43 is limited by the lower shoulder 45 on the sleeve. This downward stroke is sufficient in length to expose the connector plug 35. The connector plug 35 is normally sheltered by the surrounding guard sleeve 43. The connector plug 35 functions as a male connector. The J-slot 41 is used to assure mechanical connection. The sleeve 40 supporting the J-slot is rotatable, being caught between two shoulders and permitted to rotate. On rotation, alignment is achieved with an overshot 50 for that purpose. An important factor is the fact that the male plug 35 makes electrical contact to be made for proper operation.

Attention is now directed to the overshot 50 shown in FIG. 3. Construction of this device will be set forth proceeding from the top end. At the very top, there is a sleeve 51 which encloses a connective fitting 52. This fitting 52 is used to complete connection to the electrical conductors in an armored logging cable (not shown). The logging cable is terminated at the electrical connector 52 and also incorporates a threaded sleeve (not shown) which threads on the interior of the sleeve 51 to thereby make mechanical connection to the overshot shown in FIG. 3. The electrical connector 52 is sealed by a set of O-rings at 53 and it is supported on a plug 54, the plug 54 supporting the upstanding sleeve 51, previously mentioned. The plug 54 threads to a fixed external sleeve 55 which encloses suitable seals and threaded connectors which surround the internal conducting wire enclosed within an armored jacket 56.

The body supports a resilient external sleeve 57 which has a number of centralizing rings or ribs 58. Moreover, they function as a fluid seal. In ordinary use, the overshot 50 is dropped in drill pipe. It will travel as far as possible along the drill pipe. It may stall as a result of the highly deviated well. The overshot is forced along the remaining length of the drill pipe string by pumping drilling fluid behind the overshot. The resilient rings are large enough so that a pressure differential is created which faces or pumps the overshot through the drill pipe. An open annulus is present between the drill pipe I.D. and the resilient ring O.D. to allow drilling fluid to flow around so that the overshot can be recovered at a faster speed when required. Enough force is created to pump down the overshot while still allowing fluid to by-pass the resilient rings and circulate through the drill pipe. The overshot is then forced to the bottom of the well by means of the hydraulic drive behind the resilient members on the exterior of the overshot body.

Forward of the resilient sleeve, the overshot is constructed to include an external protruding rod-like member which includes a number of sinker bars at 59. The sinker bars surround the armored conductor jacket 56 on the interior. One or more sinkers are included, depending on the weight required to cause the apparatus to travel to the very extreme end of the string of drill pipe. Suitable seals and spacers are incorporated for construction of the apparatus forward of the resilient member 57 and which will be termed the stinger. The stinger is indicated generally by the numeral 60 and refers to that portion which is forward or below the resilient member 57 just described.

The stinger incorporates a threaded member 61 which threads to a hollow sleeve 62. The sleeve is perforated with openings at 63 to enable pressure equalization between the exterior and the interior of the sleeve. The armored conductor jacket 56 extends downwardly to the electrical fitting 64 on the interior. The fitting 64 is held by a series of insulated washers and a nut at the top end of the fixed electrical connector fitting 64. The fitting 64 supports a flexible multiconductor conduit 65 extending from the lower end and spaced from the walls of the surrounding sleeve 62. The sleeve 62 threads to a continuation sleeve which functions as an alignment cylinder 66. Internal pressure is equalized by providing the drilled hole 67 in it. The sleeve 62 terminates at an interior shoulder providing a seat for a coil spring 69. The coil spring 70 is compressed against the shoulder of sleeve 62. The spring 69 cooperates with an overshot piston 70, the piston 70 having an upstanding axial sleeve 71 which fits loosely around the conduit 65. There is sufficient gap to enable the wire to bend or flex. While the sleeve 71 rises in the tool, there is sufficient clearance to avoid pinching the wire 65.

The piston 70 is shown in the downward stroke or position. The conduit 65 connects at its lower extremity to a boot 71 which encloses the conductors connecting with a set of connector rings on the interior of a female socket 72. The piston 70 clamps to the boot 71 so they move together. The boot 71 and the socket are normally made as a single unit and move as a unit. The socket 72 is axially aligned and will ultimately connect with the male plug 35 on the wet connector 25 shown in FIG. 2. Thus, the tip of the plug 35 stabs into the socket 72 thereby completing the connection. In the downward stroke, travel of the socket is limited by the shoulder at 73. This shoulder axially limits movement of the socket 72 to prevent piston and boot from falling out of overshot because of spring force. The socket 72 can move upwardly, this movement being accompanied by upward movement of the piston 70 and compression of the spring 69. This movable portion of the equipment is urged downwardly normally by the spring 69, but the spring force can be overcome. The upper end of the sleeve 71 extends around and is loosely spaced from the wire 65 to avoid pinching. Upward travel to the maximum permitted does not pinch any surplus or extra length of the conduit 65 which coils loosely in the extra space permitted for coiling.

The sleeve 66 is provided with a pressure equalizing opening at 74. Therebelow, the sleeve 66 threads to a sleeve 75 for ease of assembly and disassembly and to also define the interior should 73. The bottom sleeve 75 is an extender sleeve having the same external diameter as the sleeve 66. The sleeve 75 has a downwardly facing internal shoulder 76. The shoulder 76 has an axial opening to enable the plug 35 to extend upwardly past the shoulder. However, the shoulder 76 is sized to align the guard sleeve 43 previously mentioned. The guard sleeve 43 will be driven down to expose the plug 35 because it will rub against inner sleeve and then will extend upward due to force of the spring 44. The guard sleeve assists in closer, more accurate alignment for mating the plug and socket.

In addition, opposing pins 77 are included to engage the J-slots 41. They provide a solid mechanical connection, it being observed that the pins 77 connect to the sleeve 75 which in turn is structurally solid from there to the top end of the overshot 50. Thus, this solid construction enables tension to be taken on the overshot body.

In operation, the string of drill pipe at 10 is placed in the well to locate the logging apparatus at the required depth. Once this has been accomplished, the overshot 50 is dropped into the drill string. If it falls fully to the bottom and achieves connection, that is well and good. It if stalls, drilling fluid can then be pumped down the string of drill pipe. In any case, the overshot is forced to the bottom by gravity free-fall, use of weighted bars 59, and pumping down. When it comes to the vicinity of the wet connector 25 shown in FIG. 2, the following occurs. The stringer 60 is first of all centralized through the centralizing cups 14 on the interior of the string of drill pipe. Once centralized, the stringer is aligned with the wet connector. Upon centralization, it stabs into the wet connector 25. This movement helps to perfect a mechanical connection as well as an electrical connection.

The sleeve 75 passes over the upper end of the wet connector assembly. Simultaneously, the inwardly protruding pins 77 (preferable a pair to cooperate with a pair of J-slots) enter into the topmost gap in the J-slots. They travel along the respective J-slots, and are able to force the sleeve 40 supporting the J-slots to rotate when the pins 77 bottom out. In FIG. 2 of the drawings, the dotted line position at 80 shows the bottom extremity of the movement of the pin 77 in the J-slot mechanism. A pull is taken on the wireline from the surface and if proper J-slot engagement has occurred, the pin 77 moves from the dotted line position at 80 to the upper dotted line position at 81. This assures the operator at the surface that a proper mechanical connection has been made. As long as the equipment has this connection, the overshot cannot be pulled free. If desired or conditions render it necessary, the wireline may be pulled free of the cable head by pulling a predetermined load with a calculated weal point at the cablehead. On slacking off, the pin moves from the dotted line position at 81 back towards to the dotted line position at 80. This, then, permits the pin to move out of J-slot to achieve complete disengagement. Thus, a down/up/-down/up movement sequence is required to engage and disengage. This permits the equipment to be mechanically connected with a high degree of certainty and then to achieve disconnection with equal certainty.

While the foregoing describes the mechanical connection that is accomplished, the electrical connection should be noted also. The male plug 35 makes proper connection with the socket 72. Relative upward movement to connect is permitted. The overshot piston 70 is able to move upwardly. The range of travel permitted by the piston 70 overcomes or is greater than the range of travel required to accomplish J-slot latching. Thus, while the pin 77 move through the various positions in the J-slot to accomplish locking, the piston 70 is able to ride upwardly or downwardly to assure connection between the plug 35 and the socket 72. Maximum travel of the overshot is limited by the upward facing shoulder 39 of the housing 36. In other words, overrunning is not permitted. While this linear travel is accomplished between the overshot and the wet connector, on the interior of the overshot, the socket 72 rides upwardly and downwardly to make contact with the plug 35. The spring 69 bears against the plug and socket connection to assure that the connection is held continuously.

After a signal is received through the electrical conductors, the connection has been made, and the signal can be monitored to assure that the connection is continued. This electrical connection through the plug and socket operates without regard to the load on the pins 77 and the cooperative J-slots. This is a means of assuring connection even when drilling fluids may be in the vicinity. Even so, the plug and socket are able to make connection, both in dry environment or wet with drilling fluid. Their connection is made electrically sound and safe by the application of the spring force through the spring 69. Yet, they are not a load bearing connection. They are simply stabbed together and pulled apart, in the ordinary operation of the overshot, provided the J-slot connector mechanism handles the mechanical load. This shifts the load away from the electrical connectors.

While the foregoing is directed to the preferred embodiment, the scope thereof is determined by the claims which follow.

We claim:

1. For use in a logging tool system positioned in a well borehole by a drill string and exposed to drilling fluid in the well, a connective apparatus enabling the logging tool system to be selectively connected to a conductor system in a wireline, the connective apparatus comprising:

(a) a wet connector having:
  (1) a lower end located terminal means adapted to be connected to a logging tool system on a drill pipe conveyed logging system;
  (2) an upwardly facing first electrical mating means connected to said terminal means;
  (3) an upwardly facing first mechanical mating means;

(b) a wireline supported overshot having:
  (1) means connecting to a wireline;
  (2) second electrical mating means;
  (3) second mechanical mating means;

(c) wherein:
  (1) said overshot positions said first and second mechanical mating means for achieving positive mechanical connection after travel of said overshot through said drill pipe;
  (2) said first and second electrical mating means achieve electrical connection to provide an electrical path from said logging system to said wireline;
  (3) said positive mechanical connection avoids placing a mechanical load on said electrical mating means;
  (4) said overshot is retrievable along said drill pipe after release of said mechanical and electrical connections;
  (5) said wet connector electrical mating means is concentric within said upwardly facing first mechanical mating means; and
  (6) said first mechanical mating means includes a telescoping sleeve resiliently forced upwardly around said first electrical mating means and including means on said overshot for forcing said sleeve downwardly to expose said upwardly facing first electrical mating means.

2. For use in a logging tool system positioned in a well borehole by a drill string and exposed to drilling fluid in the well, a connective apparatus enabling the logging tool system to be selectively connected to a conductor system in a wireline, the connective apparatus comprising:

(a) a wet connector having:
  (1) a lower end located terminal means adapted to be connected to a logging tool system on a drill pipe conveyed logging system;
  (2) an upwardly facing first electrical mating means connected to said terminal means;
  (3) an upwardly facing first mechanical mating means;

(b) a wireline supported overshot having:
  (1) means connecting to a wireline;
  (2) second electrical mating means;
  (3) second mechanical mating means;

(c) wherein:
  (1) said overshot positions said first and second mechanical mating means for achieving positive mechanical connection after travel of said overshot through said drill pipe;
  (2) said first and second electrical mating means achieve electrical connection to provide an electrical path from said logging system to said wireline;
  (3) said positive mechanical connection avoids placing a mechanical load on said electrical mating means;
  (4) said overshot is retrievable along said drill pipe after release of said mechanical and electrical connections;
  (5) said first mechanical mating means includes a sleeve having an upper end and said upper end has a slot extending therealong for receipt of a pin carried by said overshot and wherein said slot is a J-slot for locking said pin on entry thereinto.

3. For use in a logging tool system positioned in a well borehole by a drill string and exposed to drilling fluid in the well, a connective apparatus enabling the logging tool system to be selectively connected to a conductor system in wireline, the connective apparatus comprising:

(a) a wet connector having:
(1) a lower end located terminal means adapted to be connected to a logging tool system on a drill pipe conveyed logging system;
(2) an upwardly facing first electrical mating means connected to said terminal means;
(3) an upwardly facing first mechanical mating means;
(b) a wireline supported overshot having:
(1) means connecting to a wireline;
(2) second electrical mating means;
(3) second mechanical mating means;
(c) wherein:
(1) said overshot positions said first and second mechanical mating means for achieving positive mechanical connection after travel of said overshot through said drill pipe;
(2) said first and second electrical mating means achieve electrical connection to provide an electrical path from said logging system to said wireline;
(3) said positive mechanical connection avoids placing a mechanical load on said electrical mating means;
(4) said overshot is retrievable along said drill pipe after release of said mechanical and electrical connections;
(5) said wet connector includes an upwardly extending probe supporting said first mechanical mating means at the upper end thereof and concentric of the drill pipe, and means for directing said overshot axially along the drill pipe into connection with said wet connector.

4. For use in a logging tool system positioned in a well borehole by a drill string and exposed to drilling fluid in the well, a connective apparatus enabling the logging tool system to be selectively connected to a conductor system in a wireline, the connective apparatus comprising:
(a) a wet connector having:
(1) a lower end located terminal means adapted to be connected to a logging tool system on a drill pipe conveyed logging system;
(2) an upwardly facing first electrical mating means connected to said terminal means;
(3) an upwardly facing first mechanical mating means;
(b) a wireline supported overshot having:
(1) means connecting to a wireline;
(2) second electrical mating means;
(3) second mechanical mating means;
(c) wherein:
(1) said overshot positions said first and second mechanical mating means for achieving positive mechanical connection after travel of said overshot through said drill pipe;
(2) said first and second electrical mating means achieve electrical connection to provide an electrical path from said logging system to said wireline;
(3) said positive mechanical connection avoids placing a mechanical load on said electrical mating means;
(4) said overshot is retrievable along said drill pipe after release of said mechanical and electrical connections;
(5) said wet connector includes a central male electrical plug comprising said first electrical mating means, and said overshot includes a mating female socket comprising said second electrical mating means and further including resilient means using said first and second electrical mating means into telescoping connection.

5. The apparatus of claim 4 including first and second spaced shoulder means capturing a compressed coil spring therebetween to comprise said resilient means, and wherein said coil spring is overcome by forcing said plug and socket together.

6. The apparatus of claim 5 wherein one of said shoulders is relatively fixed to said socket, and the other of said shoulders is relatively fixed on said overshot.

7. The apparatus of claim 6 wherein said coil spring is around a movable piston, said piston being axially hollow to receive said coil spring on the exterior thereof and an electrical conduit therethrough for connection to said socket and extending thereabove to said said wireline.

8. For use in a logging tool system positioned in a well borehole by a drill string and exposed to drilling fluid in the well, a connective apparatus enabling the logging tool system to be selectively connected to a conductor system in a wireline, the connective apparatus comprising:
(a) a wet connector having:
(1) a lower end located terminal means adapted to be connected to a logging tool system on a drill pipe conveyed logging system;
(2) an upwardly facing first electrical mating means connected to said terminal means;
(3) an upwardly facing first mechanical mating means;
(b) a wireline supported overshot having:
(1) means connecting to a wireline;
(2) second electrical mating means;
(3) second mechanical mating means;
(c) wherein:
(1) said overshot positions said first and second mechanical mating means for achieving positive mechanical connection after travel of said overshot through said drill pipe;
(2) said first and second electrical mating means achieve electrical connection to provide an electrical path from said logging system to said wireline;
(3) said positive mechanical connection avoids placing a mechanical load on said electrical mating means;
(4) said overshot is retrievable along said drill pipe after release of said mechanical and electrical connections;
(5) said overshot includes a rigid connection along the length of said overshot with said second mechanical mating means, and supports on a resilient means said second electrical mating means to permit said second electrical mating means to move along said overshot against resistance of said resilient means to achieve alignment of said first and second electrical mating means independently of position of said overshot relative to said wet connector.

9. The apparatus of claim 8 wherein said second mechanical mating means comprises protruding pin means connecting into a cooperative J-slot on said wet connector which comprises said second mechanical mating means.

10. For use in a logging tool system positioned in a well borehole by a drill string and exposed to drilling fluid in the well, a connective apparatus enabling the logging tool system to be selectively connected to a conductor system in a wireline, the connective apparatus comprising:

(a) a wet connector having:
  (1) a lower end located terminal means adapted to be connected to a logging tool system on a drill pipe conveyed logging system;
  (2) an upwardly facing first electrical mating means connected to said terminal means;
  (3) an upwardly facing first mechanical mating means;

(b) a wireline supported overshot having:
  (1) means connecting to a wireline;
  (2) second electrical mating means;
  (3) second mechanical mating means;

(c) wherein:
  (1) said overshot positions said first and second mechanical mating means for achieving positive mechanical connection after travel of said overshot through said drill pipe;
  (2) said first and second electrical mating means achieve electrical connection to provide an electrical path from said logging system to said wireline;
  (3) said positive mechanical connection avoids placing a mechanical load on said electrical mating means;
  (4) said overshot is retrievable along said drill pipe after release of said mechanical and electrical connections; and
  (5) wherein said overshot comprises:
    (i) an elongate body;
    (ii) an internal cylinder in said body;
    (iii) an axially hollow piston slidably located in said body;
    (iv) resilient means urging said piston downwardly in said cylinder; and
    (iv) a socket comprising said second electrical mating means, said socket being supported by said piston.

11. The apparatus of claim 10 wherein said hollow piston is axially hollow to receive an electrical conductor therethrough to connect with said socket.

12. The apparatus of claim 10 including fluid equalization passage means connecting from the exterior of said overshot to said piston to enable said piston to move free of fluid pressure.

13. The apparatus of claim 10 wherein said cylinder encloses said socket to guide axial movement of said socket in said overshot with movement of said piston.

14. The apparatus of claim 10 wherein said piston structurally supports said socket axially aligned in said overshot, and further including centralizer means cooperative with said overshot and said drill string to guide said socket toward said wet connector.

15. The apparatus of claim 14 including means axially aligning said wet connector in said drill string.

16. A method of preparing to conduct logging operations a highly deviated well borehole comprising the steps of:

(a) running a string of drill pipe into a highly deviated well borehole with a logging system attached thereto and positioning the logging system at a location in the well borehole to conduct logging operations;
(b) connecting a wet connector to said logging system within the drill string;
(c) running an overshot on a wireline through the drill string until said overshot arrives at said wet connector;
(d) making a mechanical connection between said overshot and said wet connector;
(e) making an electrical connection between said overshot and said wet connector to provide a signal path from said logging system along said wireline to enable logging signals to be sent along said wireline extending to the top of the highly deviated well; and
(f) wherein said wet connector includes a guard sleeve enclosing an electrical connector means, and wherein said overshot moves said guard sleeve to expose said electrical connector means for connection thereto.

17. The method of claim 16 including the steps of:

(a) placing a drilling fluid responsive means on said overshot; and
(b) pumping drilling fluid into said drill string to force said overshot along said drill string into contact with said wet connector.

18. The method of claim 16 including the step of locking the mechanical connection between said overshot and said wet connector by pulling on said wireline after engaging said overshot to said wet connector.

* * * * *